US007221884B2

(12) United States Patent
Hirano

(10) Patent No.: US 7,221,884 B2
(45) **Date of Patent: *May 22, 2007**

(54) IMAGE FORMING APPARATUS AND METHOD OF CONTROLLING APPARATUS HAVING CONTROL SECTIONS FOR PERMITTING USE OF DIFFERENT FUNCTIONS

(75) Inventor: Yoshiharu Hirano, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/409,104

(22) Filed: Apr. 24, 2006

(65) Prior Publication Data

US 2006/0188283 A1 Aug. 24, 2006

Related U.S. Application Data

(63) Continuation of application No. 10/730,009, filed on Dec. 9, 2003, now Pat. No. 7,062,189.

(51) Int. Cl.
*G03G 21/00* (2006.01)

(52) U.S. Cl. ..... 399/80

(58) Field of Classification Search ..... 399/79–81
See application file for complete search history.

(56) References Cited

U.S. PATENT DOCUMENTS

| | | | | |
|---|---|---|---|---|
| 5,694,222 | A | 12/1997 | Yamada | |
| 5,999,766 | A | 12/1999 | Hisatomi et al. | |
| 6,122,463 | A | 9/2000 | Nagatani | |
| 6,782,217 | B1 * | 8/2004 | Ando | 399/79 |
| 6,903,840 | B1 | 6/2005 | Maymin et al. | |
| 7,062,189 | B2 * | 6/2006 | Hirano | 399/80 |

* cited by examiner

*Primary Examiner*—William J. Royer
(74) *Attorney, Agent, or Firm*—Foley & Lardner LLP

(57) ABSTRACT

If a code input by an operation of a user is a permission code, use of a scanner function is permitted. When the enable key is set, an enable code stored in an enable key is read. In a case where the read enable code coincides with a preregistered enable code, use of a printer function is permitted. If use of the scanner function and use of the printer function are both permitted, use of a facsimile function is permitted.

14 Claims, 3 Drawing Sheets

IMAGE FORMING APPARATUS AND METHOD OF CONTROLLING APPARATUS HAVING CONTROL SECTIONS FOR PERMITTING USE OF DIFFERENT FUNCTIONS

The present application is a continuation of U.S. application Ser. No. 10/730,009, filed Dec. 9, 2003, now U.S. Pat. No. 7,062,189 the entire contents of which are incorporated herein by reference.

BACKGROUND OF THE INVENTION

1. Field of the Invention

The present invention relates to a composite image forming apparatus that has a plurality of functions such as a copy function, a scanner function and a printer function, and a control method thereof.

2. Description of the Related Art

There is a composite image forming apparatus (MFP) that has a plurality of functions such as a scanner function of transmitting an image read by a scanner to the outside and a printer function of printing image data input from the outside in addition to a normal copy function.

In such a composite image forming apparatus, the copy function can be readily used as a standard function. However, use of the scanner function and the printer function is permitted only when a user buys options.

From the viewpoint of security, the use of the optionally bought scanner and printer functions may be permitted only to a specific user. In this case, by authentication of a fingerprint or an IC card, only a preregistered user can use the scanner function and the printer function.

However, a dedicated authentication device must be disposed for authentication of the fingerprint or the IC card, which causes a great increase in cost.

BRIEF SUMMARY OF THE INVENTION

The present invention has been made by taking the foregoing circumstances into consideration. An object of the invention is to provide an image forming apparatus that needs no special device disposed to authenticate a fingerprint or an IC card and that can permit use of a desired function to a specific user, and another object of the invention is to a control method thereof.

An aspect of the present invention is directed to a composite image forming apparatus that has at least a first function, a second function and a third function, comprising:

a first control section to permit use of the first function if a code input by an operation of a user coincides with a preregistered permission code;

an enable key to store an enable code;

a setting section to set the enable key;

a reading section to read the enable code stored in the enable key when the enable key is set in the setting section;

a second control section to permit use of the second function if the enable code read by the reading section coincides with a preregistered enable code; and a third control section to permit use of the third function if use of the first function and use of the second function are both permitted.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Next, an embodiment of the present invention will be described with reference to the accompanying drawings.

Figure 1:
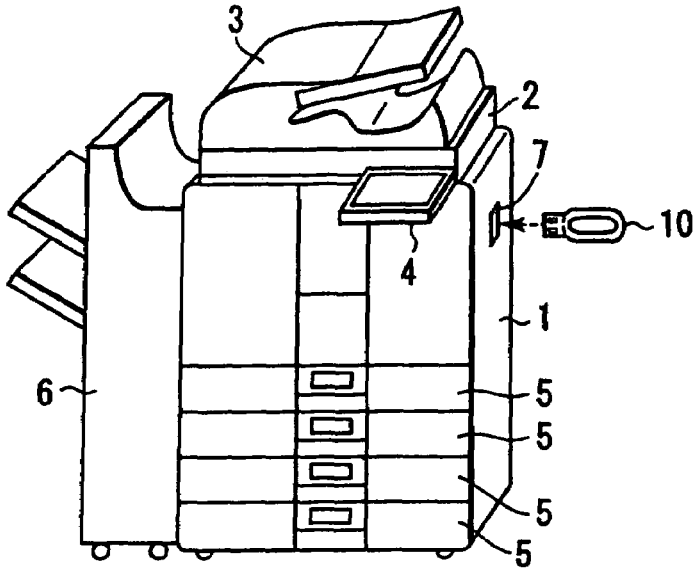
FIG. 1 is a perspective view showing an appearance of an embodiment of the present invention.
Figure 2:
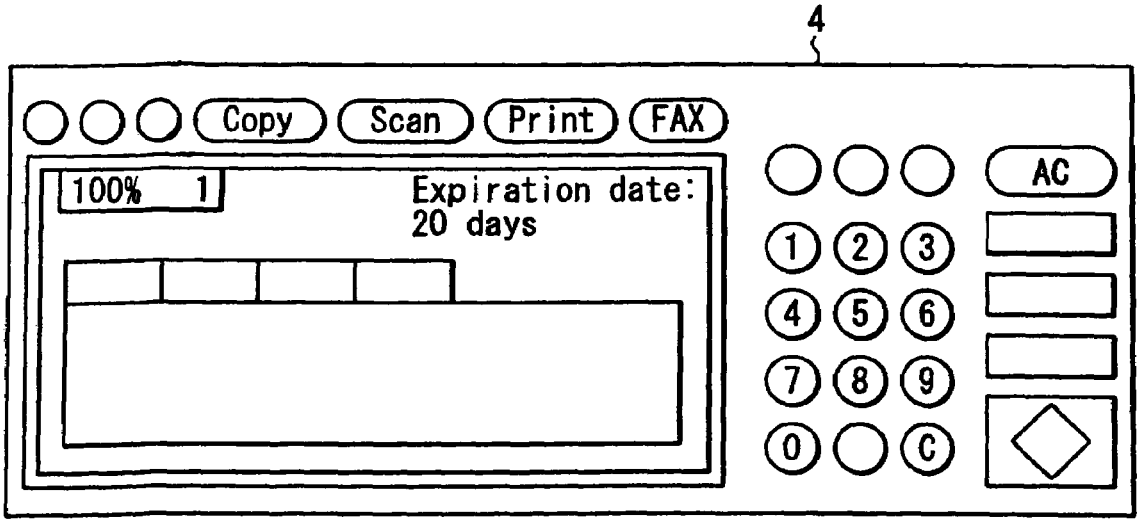
FIG. 2 is a view showing a constitution of a control panel of the embodiment.

As shown in FIG. 1, a document table 2 is disposed on a main body 1 of an image forming apparatus, and an automatic document feeder (ADF) 3 is disposed to be freely opened/closed on the document table 2. A control panel 4 shown in FIG. 2 is disposed as operation means for setting operation conditions in a position equal in height to the document table 2.

In a lower part of the main body 1, a plurality of cassettes 5 are disposed to house paper sheets of various sizes which are image forming media.

Additionally, on a side part of the main body 1, an ejection unit 6 is disposed to receive printed paper sheets that have been ejected. On the other side face of the main body 1, a USB port 7 is disposed to be a setting section of an enable key 10. The enable key 10 is designed to permit use of a printer function (second function) of the main body 1, and provided from a maker or a sales agent.

Figure 3:
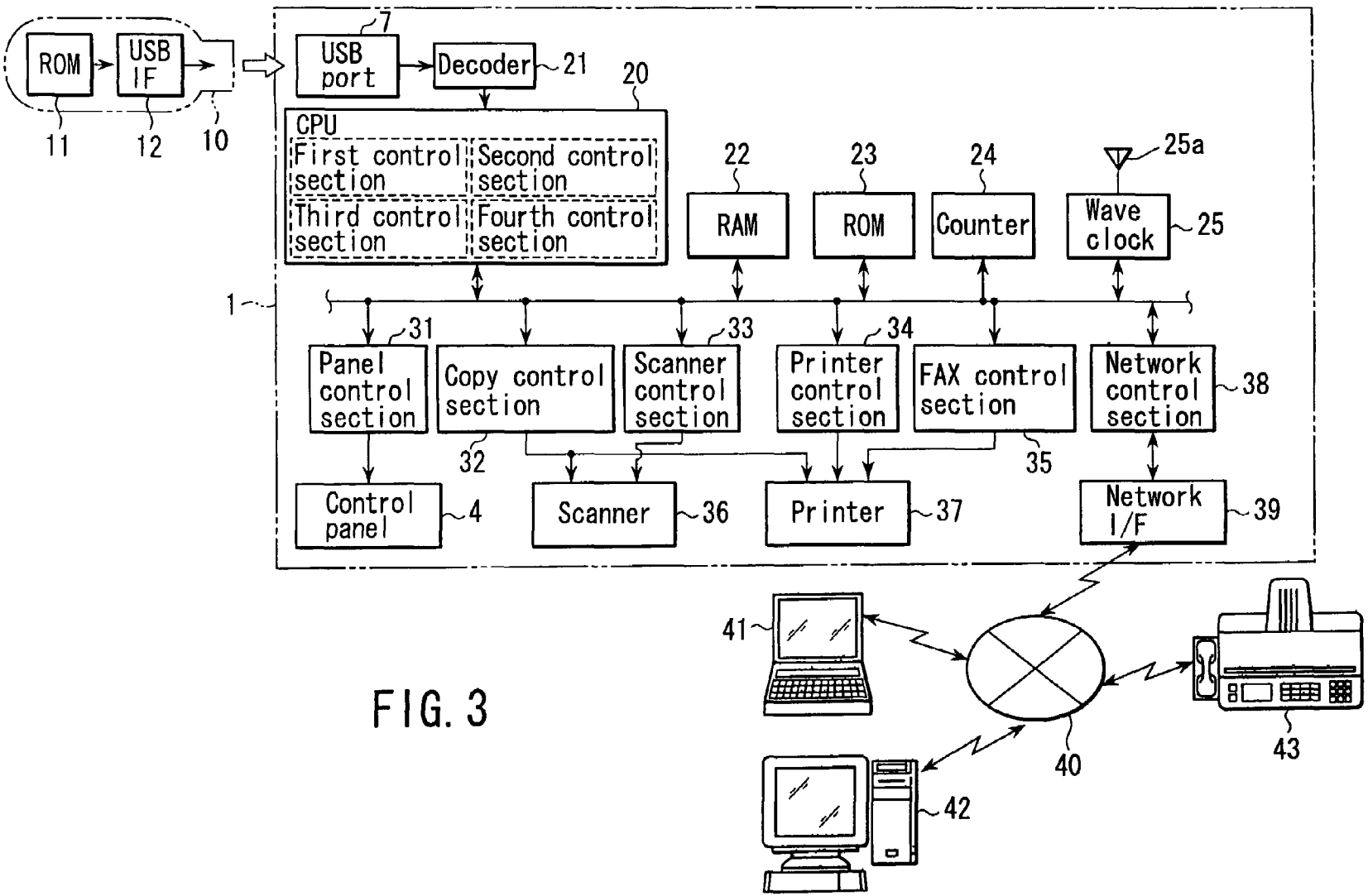
FIG. 3 is a block diagram of a control circuit of the embodiment.

FIG. 3 shows an internal constitution of the enable key 10 and a control circuit in the main body 1.

The enable key 10 incorporates a ROM 11 that stores an enable code, and a USB interface 12 that transmits the enable code from the ROM 11 to the USB port 7.

A CPU 20 that is a main control section is disposed in the main body 1. A decoder 21, a RAM 22, a ROM 23, a counter 24, a wave clock 25, a panel control section 31, a copy control section 32, a scanner control section 33, a printer control section 34, a facsimile (FAX) control section 35, and a network control section 38 are connected to this CPU 20.

The decoder 21 functions as a reading section for reading the enable code from the enable key 10 set in the USB port 7. The enable code read by the decoder 21 is supplied to the CPU 20.

The RAM 22 stores various data. In the ROM 23, various control programs necessary for an operation of the main body 1 are stored, and a permission code to permit use of a scanner function, a permission code to permit use of a printer function, an inhibition code to inhibit use of the scanner function, an inhibition code to inhibit use of the printer function, an enable code similar to that stored in the enable key 10, and the like, are preregistered.

The counter 24 counts a passage of time based on a signal supplied from the wave clock 25. The wave clock 25 has an antenna 25*a* as an accessory, and sequentially updates current time by receiving a standard time radio wave while clocking the current time.

The panel control section 31 controls the control panel 4. The copy control section 32 controls a normal copy function that uses a scanner 36 and a printer 37.

The scanner control section 33 controls the scanner function (first function) such as a network scanner that uses the scanner 36. The printer control section 34 controls the printer function (second function) such as a network printer that uses the printer 37. The facsimile control section 35 controls the facsimile function (third function) that uses the printer 37.

The network control section 38 controls data transmission/reception with an external device through a network interface 39. The network interface 39 includes a LAN board, a FAX modem and the like, and is connected through an external communication line 40 to personal computers 41, 42, a facsimile device 43 and the like, which are external devices.

The CPU 20 has first to fourth control sections.

The first control section permits use of the scanner function if a code input by an operation of the control panel 4 coincides with the scanner function permission code registered in the ROM 23. Additionally, the first control section inhibits use of the scanner function if the code input by the operation of the control panel 4 coincides with the scanner function inhibition code registered in the ROM 23.

The second control section permits use of the printer function if an enable code read from the enable key 10 set in the USB port 7 coincides with the enable code registered in the ROM 23. Additionally, the second control section inhibits use of the printer function when the enable key 10 is reset from the USB port 7.

The third control section permits use of the facsimile function if use of the scanner function and use of the printer function are both permitted, and inhibits use of the facsimile function when use of one of the scanner function and the printer function is inhibited.

The control section 4 permits use of the printer function only for a fixed period (e.g., 20 days) if contents of a scanned barcode coincide with the printer function permission code registered in the ROM 23 when the barcode on a paper sheet set on the document table 2 is scanned by the scanner 36. This fixed period is set based on deadline information contained in the scanned barcode. Additionally, the fourth control section immediately inhibits use of the printer 37 even during the fixed period if the contents of the scanned barcode coincide with the printer function inhibition code registered in the ROM 23 when the barcode on the paper sheet set on the document table 2 is scanned by the scanner 36.

Figure 4:
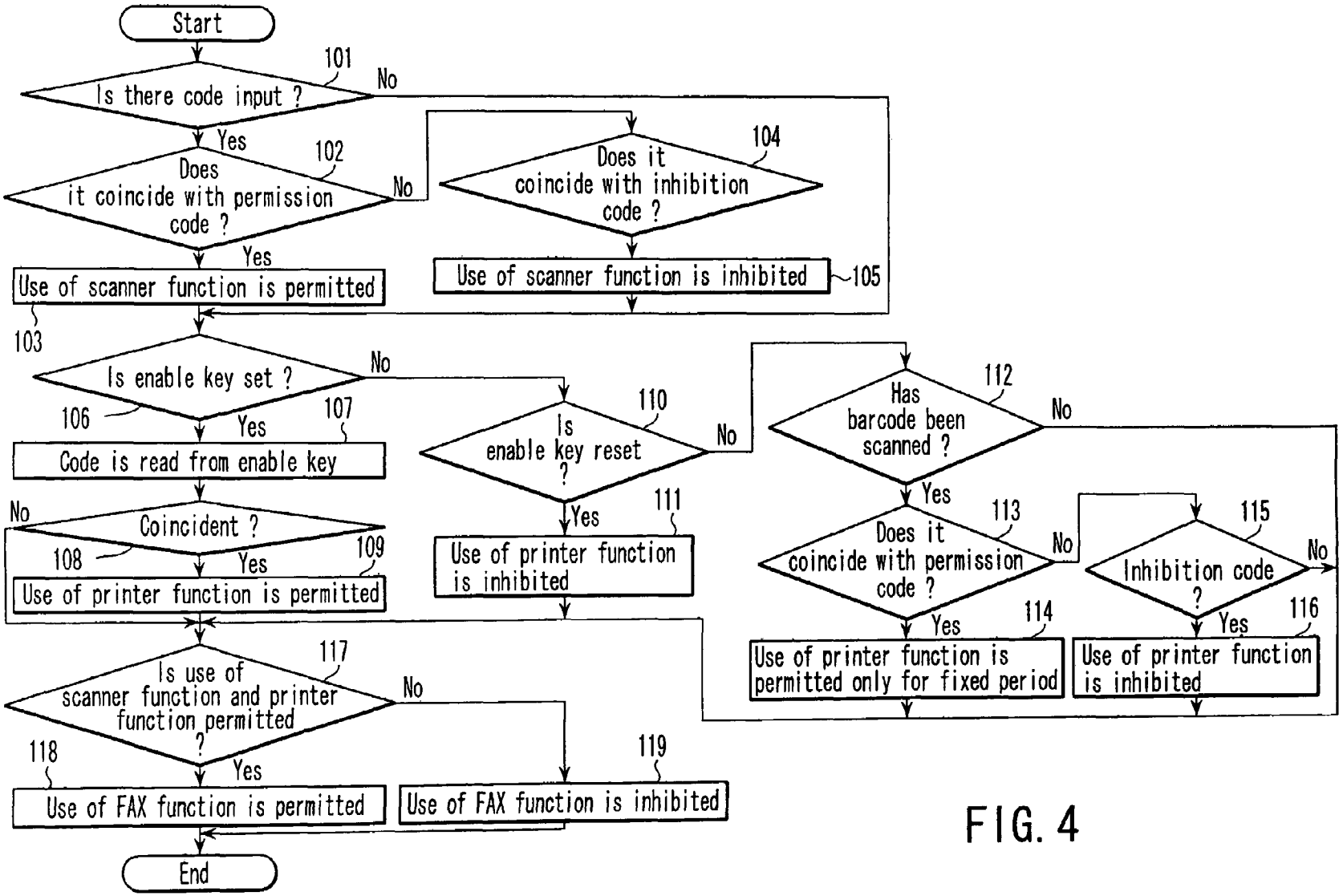
FIG. 4 is a flowchart explaining an operation of the embodiment.

Next, an operation will be described by referring to a flowchart of FIG. 4.

A user who wishes to use the scanner function inputs a predetermined code by an operation of the control panel 4 (YES in step 101). If the input code coincides with the preregistered scanner function permission code (YES in step 102), use of the scanner function is permitted (step 103). That is, a scanning command is input from the personal computer 41 through the communication line 40 to the main body 1, whereby an image of a document set on the document table 2 is read by the scanner 36. Electronic mail to which the read image is added is generated, and sent through the communication line 40 to the personal computer 41. This mail is so-called Scan To E-mail. The read document image may be stored as a file in the RAM 22. This file is so-called Scan To File.

If the code input by the operation of the control panel 4 coincides with the preregistered scanner function inhibition code (YES in step 104), use of the scanner function is inhibited (step 105).

The user who wishes to use the printer function sets the enable key 10 that the user owns in the USB port 7 (YES in step 106). At this time, an enable code is read from the enable key 10 (step 107). If the read enable code coincides with the preregistered enable code (YES in step 108), use of the printer function is permitted (step 109). That is, a printing command is input from the personal computer 41 through the communication line 40 to the main body 1, whereby image data input from the personal computer 41 is printed by the printer 37.

When the enable key 10 is reset from the USB port 7 (YES in step 110), use of the printer function is inhibited (step 111).

Figure 5:
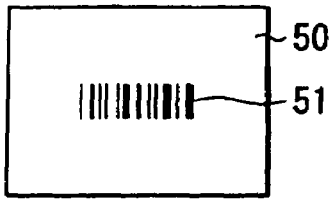
FIG. 5 is a view showing an example of a barcode of the embodiment.

Incidentally, even if the user has no enable key 10, as long as use of the scanner function is permitted, a paper sheet 50 shown in FIG. 5 is set on the document table 2 to be scanned, whereby the printer function can be used. A barcode 51 is printed on the paper sheet 50 to enable use of the printer function.

That is, when the barcode 51 on the paper sheet 50 is scanned (YES in step 112), if contents of the scanned barcode 50 coincide with the printer function permission code registered in the ROM 23 (YES in step 113), use of the printer function is permitted only for a fixed period (e.g., 20 days)(step 114). This fixed period is set based on deadline information contained in the scanned barcode 50, and measured by time counting of the counter 24.

If the contents of the scanned barcode 50 coincide with the printer function inhibition code registered in the ROM 23 (YES in step 115), use of the printer function is immediately inhibited even during the fixed period (step 116).

In place of the barcode 51, a code formed by arraying characters or signs may be printed on the paper sheet 50.

On the other hand, if use of the scanner function is permitted and even use of the printer function is permitted (YES in step 117), use of the facsimile function is permitted (step 118). That is, when the document image is read by the external facsimile device 43, the read image data is transmitted through the communication line 40 to the main body 1, and the transmitted image data is printed on the paper sheet by the printer 37. The image data scanned by the scanner 36 can also be transmitted to the facsimile device 43.

If use of one of the scanner function and the printer function is inhibited (NO in step 117), use of the facsimile function is also inhibited (step 119).

Therefore, there is no need to dispose any special device for authenticating a fingerprint or an IC card unlike the conventional case, and use of the scanner function, the printer function and the facsimile function can be permitted only to a specific user. Since no special device is necessary, no cost increase occurs.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A composite image forming apparatus that has a first function as a scanner function and a second function, comprising:

a first control section which permits use of the scanner function when a code input by a user coincides with a permission code for scanner function; and a second control section which permits use of the second function when a code scanned by the scanner function coincides with a permission code for second function.

2. The apparatus according to claim 1, wherein the second function is a printer function.

3. The apparatus according to claim 1, wherein the first control section inhibits use of the scanner function when the code input by the user coincides with an inhibition code for scanner function.

4. The apparatus according to claim 1, wherein the second control section which permits use of the second function only for a fixed period when a code scanned by the scanner function coincides with a permission code for second function.

5. The apparatus according to claim 1, further comprising:

a third function; and a third control section which permits of the third function when use of the scanner function and use of the second function are both permitted.

6. The apparatus according to claim 5, wherein the second function is a printer function, and the third function is a facsimile function.

7. A composite image forming apparatus that has a first function as a scanner function and a second function, comprising:

first control means for permitting use of the scanner function when a code input by a user coincides with a permission code for scanner function; and second control means for permitting use of the second function when a code scanned by the scanner function coincides with a permission code for second function.

8. The apparatus according to claim 7, wherein the second function is a printer function.

9. The apparatus according to claim 7, wherein the first control means inhibiting use of the scanner function when the code input by the user coincides with an inhibition code for scanner function.

10. The apparatus according to claim 7, wherein the second control means for permitting use of the second function only for a fixed period when a code scanned by the scanner function coincides with a permission code for second function.

11. The apparatus according to claim 7, further comprising:

a third function; and a third control means for permitting of the third function when use of the scanner function and use of the second function are both permitted.

12. The apparatus according to claim 11, wherein the second function is a printer function, and the third function is a facsimile function.

13. A controlling method of a composite image forming apparatus that has a first function as a scanner function and a second function, the method comprising:

permitting use of the scanner function when a code input by a user coincides with a permission code for scanner function; and permitting use of the second function when a code scanned by the scanner function coincides with a permission code for second function.

14. The method according to claim 13, wherein the second function is a printer function.

* * * * *